US007721650B2

(12) United States Patent
Barton et al.

(10) Patent No.: US 7,721,650 B2
(45) Date of Patent: May 25, 2010

(54) MODULAR TIME DELAY FOR ACTUATING WELLBORE DEVICES AND METHODS FOR USING SAME

(75) Inventors: John A. Barton, Arlington, TX (US); Lyle W. Andrich, Grandview, TX (US)

(73) Assignee: Owen Oil Tools LP, Houston, TX (US)

( * ) Notice: Subject to any disclaimer, the term of this patent is extended or adjusted under 35 U.S.C. 154(b) by 0 days.

(21) Appl. No.: 12/062,389

(22) Filed: Apr. 3, 2008

(65) Prior Publication Data

US 2008/0245255 A1 Oct. 9, 2008

Related U.S. Application Data

(60) Provisional application No. 60/910,031, filed on Apr. 4, 2007.

(51) Int. Cl.
*F42D 1/06* (2006.01)
*E21B 43/25* (2006.01)
*E21B 43/263* (2006.01)

(52) U.S. Cl. ..... 102/312; 102/313; 166/63

(58) Field of Classification Search ..... 102/310, 102/312, 313, 317, 320; 166/63, 286, 299
See application file for complete search history.

(56) References Cited

U.S. PATENT DOCUMENTS 2,171,384 A * 8/1939 Young ..... 102/318
2,238,939 A * 4/1941 Lewis et al. ..... 102/317
2,377,151 A * 5/1945 Huber ..... 102/317
2,558,163 A * 6/1951 Wright et al. ..... 102/317
2,590,671 A * 3/1952 Baker ..... 102/317
2,935,020 A * 5/1960 Howard et al. ..... 102/307
3,013,492 A * 12/1961 Sexton ..... 102/317
3,057,296 A * 10/1962 Silverman ..... 181/116
3,131,633 A * 5/1964 Eisler et al. ..... 181/116
3,246,602 A * 4/1966 Meredith et al. ..... 102/317
3,422,760 A * 1/1969 Mohaupt ..... 102/313
3,926,119 A * 12/1975 Hurst et al. ..... 102/501
4,074,629 A * 2/1978 Colgate ..... 102/313
4,215,631 A 8/1980 Rucker
RE30,621 E 5/1981 Calder, Jr. et al.
4,329,925 A * 5/1982 Hane et al. ..... 102/310
4,382,410 A * 5/1983 Bowling et al. ..... 102/310
4,425,850 A * 1/1984 Grossler ..... 102/307
4,614,156 A 9/1986 Colle, Jr. et al.
4,798,244 A * 1/1989 Trost ..... 166/250.01
5,062,485 A 11/1991 Wesson et al.
5,078,210 A 1/1992 George (Continued)

*Primary Examiner*—Bret Hayes
(74) *Attorney, Agent, or Firm*—Mossman, Kumar & Tyler, PC

(57) ABSTRACT

An apparatus for controlling a wellbore energy train may include a firing head, a detonator cord associated with the firing head, and a plurality of serially aligned modules. Each module may include an enclosure, a first portion of a high order detonation material positioned at one end of the enclosure, a second portion of the high order detonation material positioned at the other end of the enclosure, and a low order detonation material interposed between the first portion and the second portion. A method for controlling an energy train generated in a wellbore may include serially aligning a plurality of the modules along the path of the energy train, and detonating at least one of the plurality of modules by detonating a detonator cord.

19 Claims, 2 Drawing Sheets

U.S. PATENT DOCUMENTS 5,099,763 A * 3/1992 Coursen et al. ..... 102/313
5,155,293 A 10/1992 Barton
5,287,924 A 2/1994 Burleson et al.
5,355,957 A 10/1994 Burleson et al.
5,435,250 A * 7/1995 Pollock ..... 102/317
5,690,171 A * 11/1997 Winch et al. ..... 166/63
5,887,654 A 3/1999 Edwards et al.
5,890,539 A 4/1999 Huber et al.
6,182,750 B1 2/2001 Edwards et al.
6,213,203 B1 4/2001 Edwards
6,354,374 B1 3/2002 Edwards et al.
6,631,684 B2 * 10/2003 Kang ..... 102/312
6,666,141 B2 * 12/2003 Hagerty ..... 102/282
6,679,175 B2 * 1/2004 Gavrilovic ..... 102/302
7,104,326 B2 * 9/2006 Grattan et al. ..... 166/297
7,210,409 B2 * 5/2007 Johnson ..... 102/317
7,306,038 B2 * 12/2007 Challacombe ..... 166/299

* cited by examiner

MODULAR TIME DELAY FOR ACTUATING WELLBORE DEVICES AND METHODS FOR USING SAME

CROSS-REFERENCE TO RELATED APPLICATIONS

This application takes priority from U.S. Provisional Patent Application Ser. No. 60/910,031, filed Apr. 4, 2007.

BACKGROUND OF THE DISCLOSURE

1. Field of the Disclosure

The present disclosure relates to devices and methods for selective actuation of wellbore tools. More particularly, the present disclosure is in the field of control devices and methods for selective firing of a gun assembly.

2. Description of the Related Art

Hydrocarbons, such as oil and gas, are produced from cased wellbores intersecting one or more hydrocarbon reservoirs in a formation. These hydrocarbons flow into the wellbore through perforations in the cased wellbore. Perforations are usually made using a perforating gun loaded with shaped charges. The gun is lowered into the wellbore on electric wireline, slickline, tubing, coiled tubing, or other conveyance device until it is adjacent the hydrocarbon producing formation. Thereafter, a surface signal actuates a firing head associated with the perforating gun, which then detonates the shaped charges. Projectiles or jets formed by the explosion of the shaped charges penetrate the casing to thereby allow formation fluids to flow through the perforations and into a production string.

In many situations, a perforation activity may utilize an assembly of several guns. In such situations, it may be advantageous to have the ability to determine whether all the guns in a gun assembly have fired. One such situation is where two or more guns of a perforating gun assembly include firing heads that are configured to activate at the same applied pressure. Variances in operating equipment and/or design tolerances may cause the firing heads to respond to slightly different applied pressures. Also, the firing heads may be configured to activate at different applied pressures. In either case, it may be advantageous to be able to fire the guns in a manner that ensures all firing heads have sufficient time to activate upon application of pressure. Another situation is where the firing sequence does not permit a clear detection of the firing of each gun in the assembly. If the non-firing of a gun can be easily determined, a firing sequence can be retrieved to cause a firing of any gun that did not fire. Moreover, if less than all the guns have fired, certain procedures may be used at the surface when retrieving the guns to prevent an unintended detonation of any gun that has not fired.

The conventional firing systems for various reasons, such as capacity, reliability, cost, and complexity, have proven inadequate for these and other applications. The present disclosure addresses these and other drawbacks of the prior art.

SUMMARY OF THE DISCLOSURE

In aspects, the present disclosure provides an apparatus for controlling an energy train generated in a wellbore. The energy train may be associated with the firing of a perforating gun or the operation of some other wellbore tool. The apparatus may include a firing head, a detonator cord associated with the firing head, and a plurality of serially aligned modules. One of the modules may be energetically coupled to the detonator cord. Moreover, each module may include an enclosure having a first open end and a second open end, a first portion of a high order detonation material positioned at the first open end, a second portion of the high order detonation material positioned at the second open end, and a low order detonation material interposed between the first portion and the second portion. In arrangements, at least one of the plurality of modules is configured such that the detonation of the first portion detonates the low order detonation material and the detonation of the low order detonation material detonates the second portion. In aspects, a booster charge may be energetically coupled to the detonator cord. Also, a transition detonator may energetically couple the detonator cord to at least one of the plurality of modules. The transition detonator may be formed at least partially of a high order detonation material. In embodiments, the apparatus may have a housing receiving the detonator cord and the plurality of modules. The modules may be configured to be slid into the housing. In arrangements, the first portion of at least one module of the plurality of modules may be energetically coupled to one of: (a) a first portion of an adjacent module, and (b) a second portion of the adjacent module.

In aspects, the present disclosure provides a method for controlling an energy train generated in a wellbore. The method may include serially aligning a plurality of modules along the path of the energy train, and detonating at least one of the plurality of modules by detonating a detonator cord. Each module may include an enclosure having a first open end and a second open end, a first portion of a high order detonation material positioned at the first open end, a second portion of the high order detonation material positioned at the second open end, and a low order detonation material interposed between the first portion and the second portion. In arrangements, the method may include configuring at least one of the plurality of modules such that the detonation of the first portion detonates the low order detonation material and the detonation of the low order detonation material detonates the second portion. In variants, the method may also include detonating the detonator cord by using a booster charge. In arrangements, the method may further include energetically coupling the detonator cord to at least one of the plurality of modules using a transition detonator, wherein the transition detonator is formed at least partially of a high order detonation material.

In aspects, the present disclosure provides an apparatus for controlling an energy train used to activate a wellbore tool. The apparatus may include a housing, a module slidably received into the housing, and a firing head positioned external to the housing. The module may include a support member having a first open end and a second open end, a first energetic material inside the support member, the first energetic material being configured to cause a low order detonation; and a second energetic material in the support member, the second energetic material being configured to cause a high order detonation. In embodiments, the apparatus may include at least one module wherein the first energetic material is disposed between a first portion and a second portion of the second energetic material. In aspects, the first portion may detonate the first energetic material and the first energetic material may detonate the second portion. In variants, the first energetic material may have a burn rate on the order of seconds and the second energetic material may have a burn rate on the order of microseconds. In aspects, the apparatus may include a plurality of modules being positioned in the housing, each of the plurality of modules having a predetermined amount of the first energetic material. In aspects, each of the plurality of modules may include a portion of the second energetic material.

It should be understood that examples of the more illustrative features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DESCRIPTION OF THE DISCLOSURE

Figure 1:
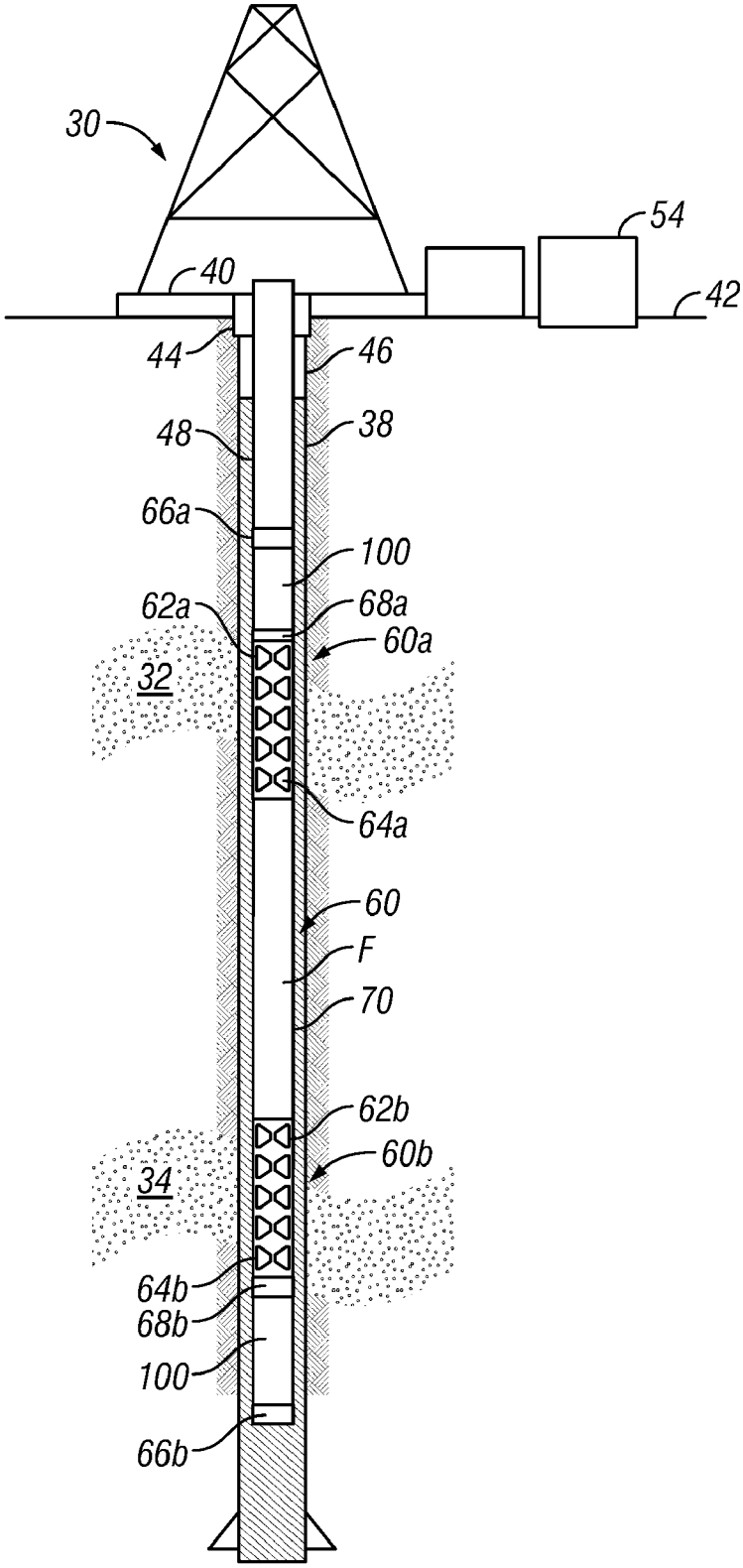
FIG. 1 schematically illustrates a perforating gun assembly made in accordance with one embodiment of the present disclosure.

The present disclosure relates to devices and methods for actuating downhole tools. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

Referring initially to FIG. 1, there is shown a well construction and/or hydrocarbon production facility 30 positioned over subterranean formations of interest 32, 34. The facility 30 can be a land-based or offshore rig adapted to drill, complete, or service a wellbore 38. The facility 30 can include known equipment and structures such as a platform 40 at the earth's surface 42, a wellhead 44, and casing 46. A work string 48 suspended within the well bore 38 is used to convey tooling into and out of the wellbore 38. The work string 48 can include coiled tubing, drill pipe, wire line, slick line, or any other known conveyance means. The work string 48 can include telemetry lines or other signal/power transmission mediums that establish one-way or two-way telemetric communication from the surface to one or more tools connected to an end of the work string 48. A suitable telemetry system (not shown) can be known types as mud pulse, pressure pulses, electrical signals, acoustic, or other suitable systems. A surface control unit (e.g., a power source and/or firing panel) 54 can be used to monitor and/or operate tooling connected to the work string 48. The controller 54 can include a monitoring device for measuring and/or recording parameters of interest relating to the firing sequence. The monitoring device can be an acoustical tool coupled to the work string 48, a pressure sensor (not shown) in communication with the wellbore fluid, or other suitable device.

The teachings of the present disclosure may be applied to any wellbore tool wherein pyrotechnics are used in connection with activation of that tool. Merely for ease of explanation, embodiments of the present disclosure will be discussed in the context of a perforating gun assembly 60 that is coupled to an end of the work string 48. An exemplary gun assembly 60 includes a plurality of guns or gun sets 62*a-b*, each of which includes perforating shaped charges 64*a-b*, firing heads 66*a-b* and detonators 68 a-b. The guns 62*a-b* are connected to one another by a connector 70. While two guns are shown, it should be understood that the gun assembly 60 can utilize greater or fewer guns. In an exemplary deployment, an operator initiates a firing sequence for the gun assembly 60 by transmitting an activation signal to the firing heads 66*a-b*. The activation signal may be an applied pressure, an electrical signal or an impact caused by a device such as a "drop bar." Upon receiving the activation signal, the firing heads 66-*a-b* releases or generates an "energy train" that activates the detonators 68*a-b*. By energy train, it is generally meant a shock wave or thermal energy that travels along a predetermined path.

In embodiments, a modular time delay device 100 is positioned between the firing heads 66*a-b* and their respective detonators 68*a-b* to adjust or control the time needed for the energy train to travel between each firing head 66*a-b* and its respective detonator 68*a-b*. By adjustable or controllable, it is meant that the modular time delay device 100 can be configured to increase or decrease the time between the transmission of an activation signal and the eventual firing of the guns 60*a-b*. In one embodiment, the modular time delay device 100 includes a combination of energetic materials, each of which exhibit different burn characteristics, e.g., the type or rate of energy released by that material. By appropriately configuring the chemistry, volume, and positioning of these energetic materials, a desired or predetermined time delay can be in the firing sequence. Generally, the energetic materials can include materials such as RDX, HMX that provides a high order detonation and a second energetic material that provides a low order detonation. The burn rate of an energetic material exhibiting a high order detonation, or high order detonation material, is generally viewed as instantaneous, e.g., on the order of microseconds or milliseconds. The burn rate of an energetic material exhibiting a low order detonation, or low order detonation material, may be on the order of seconds. In some conventions, the high order detonation is referred to simply as a detonation and the low order detonation is referred to as a deflagration.

Figure 2:
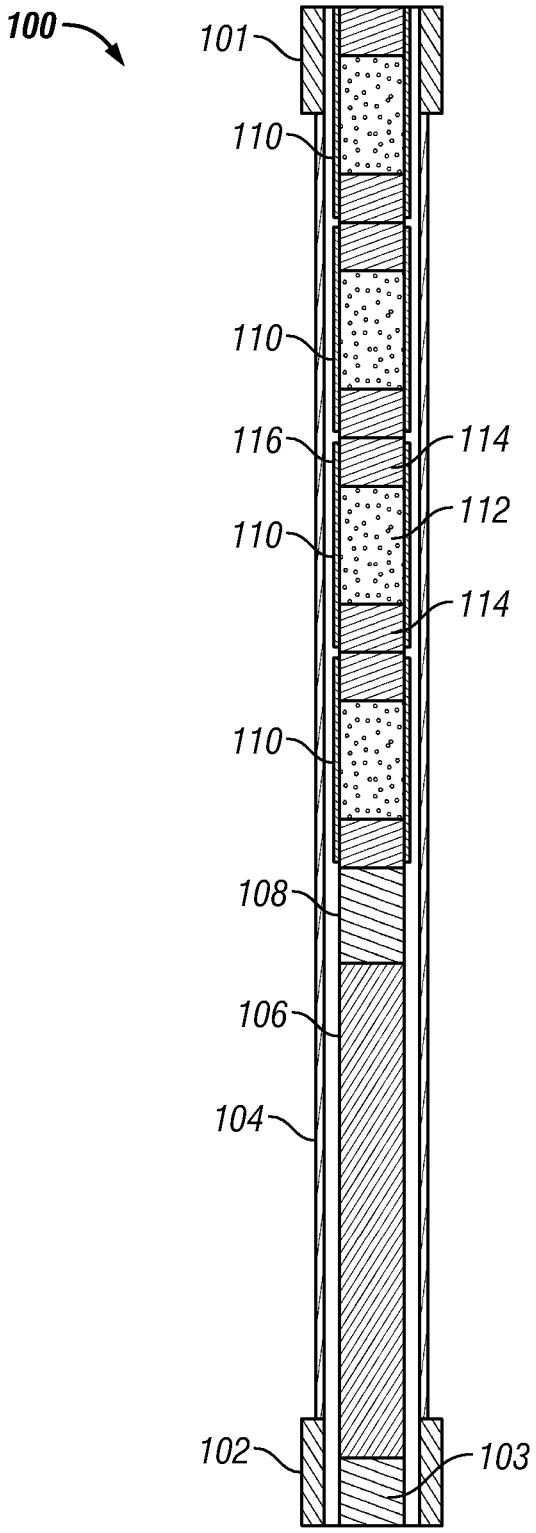
FIG. 2 schematically illustrates one embodiment of a time delay made in accordance with the present disclosure.

Referring now to FIG. 2, there is shown a modular time delay device 100 made in accordance with one embodiment of the present disclosure. The modular time delay device 100 has a first end 101 that receives an energy input and a second end 102 that provides an energy output. In one arrangement, the modular time delay device 100 has a housing 104, a detonator cord 106, a transition detonator 108 and a plurality of delay modules 110. The transition detonator 108 and the detonator cord 106, which is connected to a booster charge 103, cooperate to produce a high order detonation at the second end 102. The delay modules 110 control the time needed for an energy train to travel between the first end 101 and the second end 102. Each delay module 110 provides a preset amount of time delay. By "delay," it is generally meant the time period needed for an energy train to traverse or cross the module 110. For instance, an exemplary module 110 can provide ten second time delay, a thirty five second time delay, a sixty seconds of time delay, etc. Thus, where a module 110 has a sixty second time delay, the housing 104 may be fitted with no modules 110 for no delay, with one module 110 for a sixty seconds time delay, two modules 110 for a one hundred twenty seconds time delay, three modules 110 for a one hundred eighty seconds time delay, etc. In some embodiments, each module 110 may have the same predetermined time delay. In other embodiments, the modules 110 can be configured to provide different amounts of predetermined time delays; e.g., one module may have a ten second delay and another module may have a forty five second delay.

The modules 110 may include one or more energetic materials that exhibit a predetermined burn rate suitable for providing a desired time delay. In the arrangement shown, the module 110 uses a first energetic material 112 that exhibits a low order detonation and a second material 114 that exhibits a high order detonation. Suitable materials for the first energetic material 112 include materials that release energy over a period of seconds rather than relatively instantaneously. The material make-up, density, quantity and positioning of the first energetic material 112 may be adjusted as needed to provide a predetermined delay period. The second energetic material 114 is formulated to energetically couple the modules 110 to one another, to energetically couple the module 110 to the transition detonator 108, and to energetically couple the energy input at the end 101 to the module 110. Because each of these components is separate, the interface between each of these components creates a discontinuity that is to be crossed by the energy train. The second energetic material 114 functions much like a booster charge that ensures an efficient energy transfer across these discontinuities. It should be appreciated that in certain embodiments the module 110 may include only the first energetic material 112. That is, in applications where an energy train is expected to effectively cross such discontinuities, the second energetic material 114 may be omitted. The energetic materials 112 and 114 can be disposed in a support member such as a casing 116. The casing 116 may be a sheath or tube having open ends. In one arrangement, the second energetic materials 114 are positioned at the open ends and the first energetic material 112 is interposed between the second energetic materials 112.

Thus, the modular time delay device 100 may be described as having in a serial fashion, a high order detonation material energetically coupled to a plurality of modules, each of which include a low order detonation material interposed between high order detonation materials.

Referring now to FIGS. 1 and 2, the detonator cord 106 and the transition detonator 108 cooperate to convert the energy released from the modules 110 into a high order detonation suitable for initiating the detonators 68*a-b*. The transition detonator 108 converts the detonation of the modules 110 into a form suitable for properly detonating the detonator cord 106. The detonator cord 106 in turn undergoes a high order detonation that is transmitted the detonators 68*a-b*. The detonator cord 106 and transition detonator 108 may be formed of known explosives suitable for high order detonations. As is known, detonator cords may be cut to suit a particular length. Thus, the detonator cord 106 may be sized as needed to accommodate the number of modules 110 used.

It should be appreciated that each modular time delay device 100 used in the perforating gun assembly 60 can be configured at the surface to provide a predetermined time delay by selecting an appropriate number of modules 110. One method of implementing a desired time delay includes selecting a time delay to be inserted into a firing sequence of a particular gun, e.g., gun 60*a* or 60*b*. Next, an operator determines the number of modules 110 needed to provide the selected time delay. The modules 110 are thereafter inserted into the housing 104. The modules 110 may be configured to slide into the housing 104 and arrange themselves in an end-to-end serial fashion. As noted above, the detonator cord 106 may be cut to the proper size to span the distance between the transition detonator 108 and the output end 102. The modular time delay device 100 can then be inserted into the perforating gun 60.

During deployment, the gun assembly 60 is positioned adjacent the zones to be perforated, a firing signal is transmitted from the surface to the gun 60. This firing signal can be caused by increasing the pressure of the fluid in the wellbore via suitable pumps (not shown) or other suitable methods. The firing signal will activate the firing heads 66*a-b*. Upon receiving the firing signal, the firing heads 66*a-b* initiates a high order detonation that is applied to the first end 101 of each modular time delay device 100. This high order detonation is initially applied to the module 110 closest to the first end 101. Each module 110 in successions burns a predetermined amount of time and eventually ignites the transition detonator 108. The transition detonator 108 detonates the detonator cord 106, which then detonates the detonators 68*a-b*. Each gun 60*a-b* may utilize the same delay period or a different delay period. As the gun assembly 60 fires, each gun 60*a-b* releases energy such as acoustical waves or pressure waves. By measuring these waves or pulses, an operator can determine the number of guns 60*a-b* that have fired. It should also be appreciated that the modular time delays 100 provide time delays between sequential firing that can facilitate detection of the individual firing events. Thus, for example, if two distinct firings are measured, then personnel at the surface can be reasonably assured that all guns 60*a-b* have fired. If only one distinct firing is measured, then personnel at the surface are given an indication that a gun may not have fired.

From the above, it should be appreciated that what has been described includes an apparatus for controlling an energy train generated in a wellbore. The apparatus may include a firing head, a detonator cord associated with the firing head, and a plurality of serially aligned modules. One of the modules may be energetically coupled to the detonator cord. Moreover, each module may include an enclosure having a first open end and a second open end. A first portion of a high order detonation material may be positioned at the first open end and a second portion of the high order detonation material positioned at the second open end. A low order detonation material may be interposed between the first portion and the second portion. In arrangements, at least one of the modules is configured such that the detonation of the first portion detonates the low order detonation material and the detonation of the low order detonation material detonates the second portion. In aspects, a booster charge may be energetically coupled to the detonator cord. Also, a transition detonator may energetically couple the detonator cord to at least one of the modules. The transition detonator may be formed at least partially of a high order detonation material. In embodiments, the apparatus may have a housing receiving the detonator cord and the plurality of modules. The modules may be configured to be slid into the housing. In arrangements, the first portion of at least one module of the plurality of modules may be energetically coupled to one of: (a) a first portion of an adjacent module, and (b) a second portion of the adjacent module.

From the above, it should be appreciated that what has also been described includes a method for controlling an energy train generated in a wellbore. The method may include serially aligning the above-described modules along the path of the energy train, and detonating at least one of the plurality of modules by detonating a detonator cord.

From the above, it should be appreciated that what has also been described includes an apparatus for controlling an energy train used to activate a wellbore tool. The apparatus may include a housing, a module slidably received into the housing, and a firing head positioned external to the housing. The module may include a support member having a first open end and a second open end. The support member may be a sheath, a sleeve, a tube or other suitable structure. A first energetic material positioned inside the support member may be formulated or configured to cause a low order detonation.

A second energetic material positioned in the support member may be configured to cause a high order detonation. In embodiments, the apparatus may include at least one module wherein the first energetic material is disposed between a first portion and a second portion of the second energetic material. In aspects, the first portion may detonate the first energetic material and the first energetic material may detonate the second portion. In variants, the first energetic material may have a burn rate on the order of seconds and the second energetic material may have a burn rate on the order of microseconds. In aspects, the apparatus may include a plurality of modules being positioned in the housing, each of the plurality of modules having a predetermined amount of the first energetic material. In aspects, each of the plurality of modules may include a portion of the second energetic material.

While the above-described embodiments have been discussed in connection with a perforating gun assembly, it should be appreciated that the present teachings can readily be applied to any wellbore tool using pyrotechnics in its activation process. For example, devices such as pipe cutters and setting tools may be configured to utilize explosive energy to perform a specified task. Embodiments of the present invention can be readily used to provide a controlled delay in the firing sequence for such devices. The foregoing description is directed to particular embodiments of the present disclosure for the purpose of illustration and explanation. It will be apparent, however, to one skilled in the art that many modifications and changes to the embodiment set forth above are possible without departing from the scope and the spirit of the disclosure. It is intended that the following claims be interpreted to embrace all such modifications and changes.

The invention claimed is:

1. An apparatus for controlling an energy train generated in a wellbore, comprising:

a firing head;

a plurality of serially aligned modules that includes at least a first module and a second module, wherein the first module is energetically coupled to the firing head, and wherein each module comprises:

an enclosure having a first open end and a second open end;

a first portion of a high order detonation material positioned at the first open end;

a second portion of the high order detonation material positioned at the second open end;

a low order detonation material interposed between the first portion and the second portion;

a detonator cord associated with the second module; and a transition detonator energetically coupling the detonator cord to the second module, wherein the transition detonator is formed at least partially of a high order detonation material.

2. The apparatus according to claim 1, wherein at least one of the plurality of modules is configured such that a detonation of the first portion detonates the low order detonation material and a detonation of the low order detonation material detonates the second portion.

3. The apparatus according to claim 1 further comprising a booster charge energetically coupled to the detonator cord.

4. The apparatus according to claim 1 further comprising a housing configured to receive the detonator cord and the plurality of modules.

5. The apparatus according to claim 4 wherein the plurality of modules are configured to slide into the housing.

6. The apparatus according to claim 1 wherein the first portion of at least one module of the plurality of modules is energetically coupled to one of: (a) a first portion of an adjacent module, and (b) a second portion of the adjacent module.

7. A method for controlling an energy train generated in a wellbore, comprising:

serially aligning a plurality of modules along the path of the energy train, wherein each module comprises:

an enclosure having a first open end and a second open end;

a first portion of a high order detonation material positioned at the first open end;

a second portion of the high order detonation material positioned at the second open end; and a low order detonation material interposed between the first portion and the second portion;

energetically coupling a detonator cord to at least one of the plurality of modules using a transition detonator, wherein the transition detonator is formed at least partially of a high order detonation material;

detonating at least one module of the plurality of modules by using a firing head; and detonating the detonator cord using at least another module of the plurality of modules.

8. The method according to claim 7, further comprising configuring at least one of the plurality of modules such that a detonation of the first portion detonates the low order detonation material and a detonation of the low order detonation material detonates the second portion.

9. The method according to claim 7 further comprising detonating the detonator cord by using a booster charge.

10. The method according to claim 7 further comprising energetically coupling the detonator cord to at least one of the plurality of modules using a transition detonator, wherein the transition detonator is formed at least partially of a high order detonation material.

11. The method according to claim 7 further comprising positioning the detonator cord and the plurality of modules in a housing.

12. The method according to claim 11 further comprising sliding the modules into the housing.

13. The method according to claim 7 further comprising energetically coupling the first portion of at least one module of the plurality of modules to one of: (a) a first portion of an adjacent module, and (b) a second portion of an adjacent module.

14. An apparatus for controlling an energy train used to activate a wellbore tool, comprising:

a work string;

a first and a second perforating gun positioned along the work string;

a housing positioned between the first and the second perforating gun;

a plurality of separate modules slidably received into the housing, each module comprising:

a support member having a first open end and a second open end;

a first energetic material inside the support member, the first energetic material being configured to cause a low order detonation;

a second energetic material in the support member, the second energetic material being configured to cause a high order detonation; and a firing head positioned external to the housing and configured to apply an energy input to at least one of the modules.

15. The apparatus according to claim 14 wherein the second energetic material has a first portion at the first open end and a second portion at the second open end, and wherein the first energetic material is disposed between the first portion and the second portion of the second energetic material.

16. The apparatus according to claim 15 wherein the first portion detonates the first energetic material and the first energetic material detonates the second portion.

17. The apparatus according to claim 14 wherein the first energetic material has a burn rate on the order of seconds and the second energetic material has a burn rate on the order of microseconds.

18. The apparatus according to claim 14 further comprising a plurality of modules being positioned in the housing, each of the plurality of modules having a predetermined amount of the first energetic material.

19. The apparatus according to claim 18 wherein each of the plurality of modules includes a portion of the second energetic material.

* * * * *